US008978754B2

(12) United States Patent
Cour

(10) Patent No.: US 8,978,754 B2
(45) Date of Patent: Mar. 17, 2015

(54) CONTROLLABLY-DEFORMABLE INFLATABLE SLEEVE, PRODUCTION METHOD THEREOF AND USE OF SAME FOR PRESSURE METERING APPLICATIONS

(75) Inventor: Francis Cour, Maisons Laffite (FR)

(73) Assignee: Francis Cour, Maisons Laffite (FR)

( * ) Notice: Subject to any disclaimer, the term of this patent is extended or adjusted under 35 U.S.C. 154(b) by 0 days.

(21) Appl. No.: 12/519,555

(22) PCT Filed: Dec. 17, 2007

(86) PCT No.: PCT/FR2007/052534

§ 371 (c)(1),
(2), (4) Date: Aug. 28, 2009

(87) PCT Pub. No.: WO2008/084162

PCT Pub. Date: Jul. 17, 2008

(65) Prior Publication Data

US 2010/0038860 A1 Feb. 18, 2010

(30) Foreign Application Priority Data

Dec. 18, 2006 (FR) ..... 06 11040

(51) Int. Cl.
*E21B 33/127* (2006.01)

(52) U.S. Cl.
CPC ..... *E21B 33/1277* (2013.01)
USPC ..... 166/187; 277/334; 277/338

(58) Field of Classification Search
USPC ..... 166/187, 122; 277/334, 331, 338, 605, 277/646
See application file for complete search history.

(56) References Cited

U.S. PATENT DOCUMENTS

| | | | | | |
|---|---|---|---|---|---|
| 1,547,240 | A | | 7/1925 | Steele | |
| 2,661,064 | A | * | 12/1953 | Rockoff | 277/338 |
| 2,828,823 | A | | 4/1958 | Mounce | |
| 3,042,980 | A | * | 7/1962 | Brinsmade | 49/477.1 |
| 4,424,861 | A | * | 1/1984 | Carter et al. | 277/334 |
| 5,205,567 | A | | 4/1993 | Quinlan et al. | |
| 5,340,626 | A | | 8/1994 | Head | |
| 5,549,947 | A | * | 8/1996 | Quigley et al. | 428/36.2 |
| 5,579,839 | A | * | 12/1996 | Culpepper | 166/118 |
| 5,695,008 | A | * | 12/1997 | Bertet et al. | 166/187 |
| 5,702,109 | A | | 12/1997 | Mahin et al. | |

(Continued)

FOREIGN PATENT DOCUMENTS

| | | | |
|---|---|---|---|
| WO | 96/21083 | A1 | 7/1996 |
| WO | 2006030012 | A1 | 3/2006 |

OTHER PUBLICATIONS

International Search Report and Written Opinion dated Oct. 10, 2008.

*Primary Examiner* — Shane Bomar
*Assistant Examiner* — Kipp Wallace
(74) *Attorney, Agent, or Firm* — Bachman & LaPointe, P.C.

(57) ABSTRACT

An inflatable sleeve or packer includes a mandrel that extends along a longitudinal axis and a sealed inflatable jacket which is connected to the mandrel and selectively adopts a rest configuration or a maximum inflation configuration. The sleeve also includes a restraining sheath which covers the inflatable jacket and is at least partially formed by essentially inextensible fibers including peripheral fibers which each extend around the longitudinal axis, the peripheral fibers adopting a pleated configuration for the rest configuration of the jacket and a stretched configuration for the maximum inflation configuration thereof.

13 Claims, 4 Drawing Sheets

(56) References Cited

U.S. PATENT DOCUMENTS

| | | | | |
|---|---|---|---|---|
| 5,778,982 | A | 7/1998 | Hauck et al. | |
| 6,595,283 | B1 | 7/2003 | Turley et al. | |
| 6,779,563 | B2 * | 8/2004 | Schwert et al. | 138/98 |
| 7,584,787 | B2 * | 9/2009 | Saltel | 166/187 |
| 2004/0216871 | A1 | 11/2004 | Mendez et al. | |
| 2007/0144734 | A1 * | 6/2007 | Xu et al. | 166/187 |

* cited by examiner

CONTROLLABLY-DEFORMABLE INFLATABLE SLEEVE, PRODUCTION METHOD THEREOF AND USE OF SAME FOR PRESSURE METERING APPLICATIONS

BACKGROUND (1) Field of the Invention

The invention relates, in general, to the techniques of diagraphy and of the exploitation of underground drilling.

More precisely, the invention relates, according to a first aspect, to an inflatable sleeve also called "packer" by those skilled in the art, this sleeve comprising a mandrel extending along a longitudinal axis and a sealed inflatable jacket connected to the mandrel and selectively adopting a rest configuration or a maximum inflation configuration.

(2) Prior Art

The inflatable sleeves are well known by those skilled in the art and are traditionally used in diagraphy or in exploitation of the underground for blocking drilling, as well as in pressure metering for evaluating the mechanical parameters of the ground in situ.

Although an inflatable sleeve can, according to its application, be inflated by a gas under pressure or by a liquid under pressure, the implementation of such a sleeve is always rendered delicate by the risk of an uncontrolled deformation and/or of a rupture of its jacket.

SUMMARY OF THE INVENTION

The purpose of the invention is precisely to propose an inflatable sleeve practically exempt of such risks.

To this end, the inflatable sleeve of the invention, moreover in accordance with the generic definition that the preamble hereinabove gives to it, is substantially characterized in that it further comprises a restraining sheath covering the inflatable jacket and including a flexible structure at least partially formed of resistant fibers substantially inextensible in stretched configuration, in that these fibers include at least peripheral fibers of which each one extends around the longitudinal axis by forming with this axis an angle at least equal to 70 degrees, and more preferably at least equal to 80 degrees, and in that these peripheral fibers adopt a pleated configuration for the rest configuration of the jacket and a stretched configuration for the maximum inflation configuration of the jacket.

By convention, the property defined by the expression "essentially inextensible resistant" used in this description is considered as applicable to fibers, for example textile fibers, which have in stretched configuration, i.e. not pleated, a resistance to the traction at least fifty times greater than that of a rubber yarn of like section, and/or which respond to a traction by a rupture after a moderate relative elongation, for example less than 20%.

More preferably, the flexible structure comprises longitudinal fibers, intersecting with the peripheral fibers and extending in a direction at least substantially parallel to the longitudinal axis, the essentially inextensible fibers being for example comprised of textile fibers.

It can also be practical to provide that the flexible structure comprises peripheral elastic yarn, for example interlaced with the longitudinal fibers, and of which each one extends around the longitudinal axis and solicits the peripheral fibers in stretched configuration towards their pleated configuration.

In a preferred embodiment of the invention, the flexible structure belongs to an elastic belt with textile matrix helically wound around the jacket.

The textile matrix of the belt can then typically include warp yarn comprising said peripheral fibers, weft yarn interlaced with the warp yarn and comprising the longitudinal fibers, and elastic yarn at least substantially parallel to the warp yarn.

The inflatable sleeve of the invention is ideally applicable to the carrying out of a pressure metering sensor.

The invention also relates to a method for manufacturing an inflatable sleeve comprising a mandrel extending along a longitudinal axis and a sealed inflatable jacket selectively adopting a rest configuration or a maximum inflation configuration, this method comprising at least steps of carrying out the mandrel, of carrying out the jacket and of mounting the jacket on the mandrel, and being characterized in that it further comprises the steps consisting in:

- manufacturing a model on a scale of one of the inflatable sleeve, having the form desired for the inflatable sleeve in fully inflated configuration and having a longitudinal axis;
- helically winding, on the model and in its state of full elongation, an elastic yarn or matrix element with textile backing, such as an elastic belt with textile matrix;
- unwinding this elastic element with textile backing of the model by driving this model in rotation at constant angular velocity around its longitudinal axis; and
- using this elastic element with textile backing at constant forward movement speed, while it is unwound from the model, either to manufacture, by knitting or weaving if this element is yarn, a retaining sheath intended to cover the jacket, or, if this elastic element is a matrix, in order to wind it directly onto the inflatable sleeve arranged in rest configuration in the vicinity of the model and driven in rotation around its longitudinal axis at the same angular velocity as the model.

By convention, the expression "state of full elongation" corresponds to the state of elongation of the flexible structure starting from which the peripheral fibers of this flexible structure are fully unpleated and begin to oppose their resistance to any further elongation.

In the case where the elastic element with textile backing is an elastic belt with textile matrix wound directly on the inflatable sleeve, the respective longitudinal axes of the sleeve and of the model can be arranged parallel to each other at a distance at most equal to the circumference of the sleeve, the sleeve and the model being driven in rotation in the opposite direction or in the same direction according to whether or not the portion of the belt extending between the model and the sleeve crosses the plane passing through said longitudinal axes.

BRIEF DESCRIPTION OF THE DRAWINGS

Other characteristics and advantages of the invention will emerge clearly from the description of it provided hereinafter, for the purposes of information and which is in no way limiting, in reference to the annexed drawings, wherein.

DETAILED DESCRIPTION OF THE PREFERRED EMBODIMENT(S)

As announced hereinabove, the invention in particular relates to an inflatable sleeve, also called "packer" by those skilled in the art, the sleeve of the invention being particularly adapted to the carrying out of a pressure metering sensor but more generally able to be used in all known applications of packers.

Such a sleeve traditionally comprises a mandrel 1 extending along a longitudinal axis X, and a sealed inflatable annular jacket 2, connected to mandrel 1.

Figure 1:
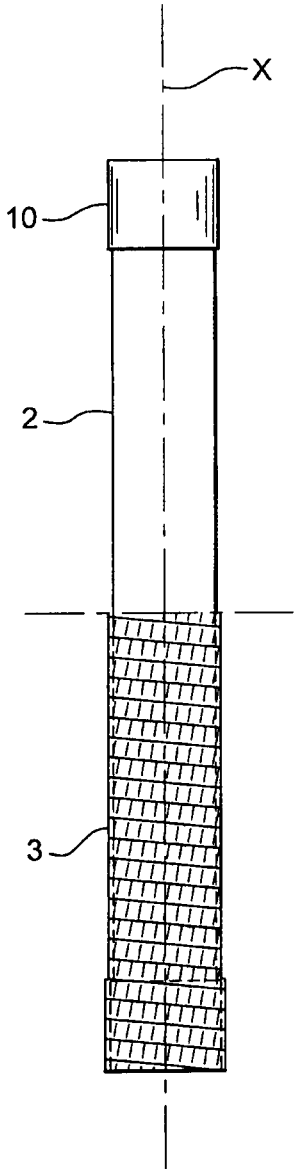
FIG. 1 is a schematic view of two halves of inflatable sleeve shown in rest configuration, the upper half being that of a known sleeve and the lower half being that of a sleeve according to the invention.
Figure 2:
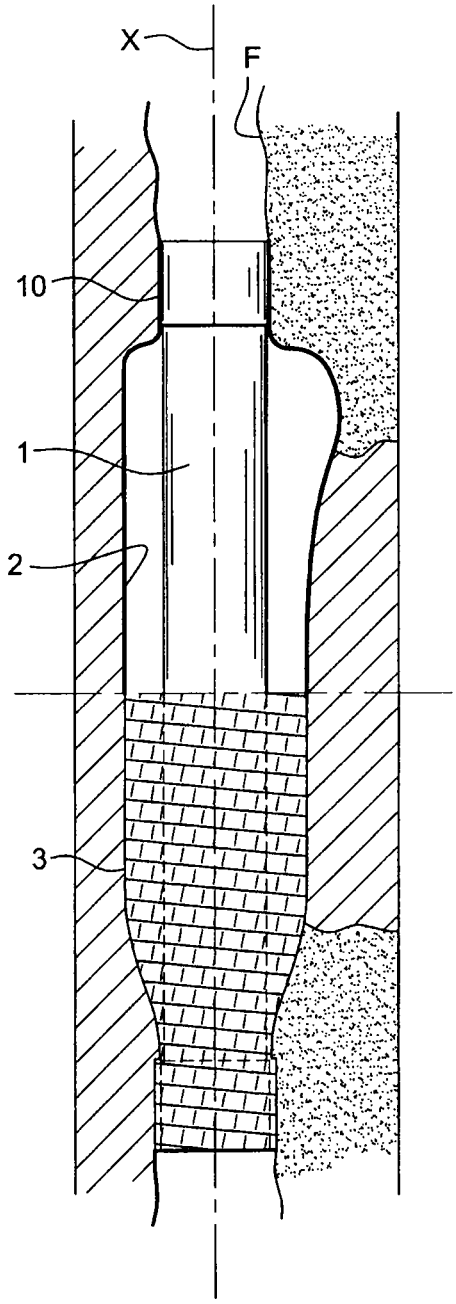
FIG. 2 is a schematic view of two halves of inflatable sleeve shown in configuration of intermediary inflation and inside a drilling F, the upper half being that of a known sleeve and the lower half being that of a sleeve according to the invention.

The inflatable jacket 2, which is typically formed of a sealed membrane of rubber or of an elastomeric mixture, is fixed to the mandrel 1 using rings 10 and can, as desired, adopt a rest configuration (FIG. 1) or a maximum inflation configuration (FIG. 2).

However, as shown in the upper portion of FIG. 2, the jacket 2 of an inflatable conventional sleeve can, according to the nature of the underground surrounding the drilling F wherein this sleeve is introduced, or in the case of a substantial annular space between the sleeve at rest and the internal wall of a drill tube wherein it is inflated, undergo uncontrolled deformations which could go as far as producing its rupture.

In order to avoid this phenomenon, the sleeve of the invention comprises a restraining sheath 3 covering the inflatable jacket 2.

This sheath 3 includes a flexible structure 4 (FIG. 4) which is at least partially formed of essentially inextensible fibers 41 and 42, for example comprised of resistant textile fibers, such as aramid fibers or Kevlar® fibers.

In particular, the structure 4 comprises peripheral fibers 41 of which each one surrounds the jacket 2 and surrounds therefore the longitudinal axis X of the sleeve by extending along a direction that is ideally perpendicular to this axis X.

In practice, these peripheral fibers 41 form with the axis X an angle at least equal to 70 degrees, and more preferably at least equal to 80 degrees.

When the jacket 2 is at rest (FIG. 1), the peripheral fibers 41 form pleats, while these fibers 41 are fully stretched and taught when the jacket 2 is inflated to the maximum (FIG. 2), due to the increase in diameter of this jacket 2.

The structure 4 is more preferably woven, in such a way that it comprises, in addition to the peripheral fibers 41, longitudinal fibers 42 which are intersecting with the peripheral fibers 41 and which extend in a direction at least substantially parallel to the longitudinal axis X.

Figure 4:
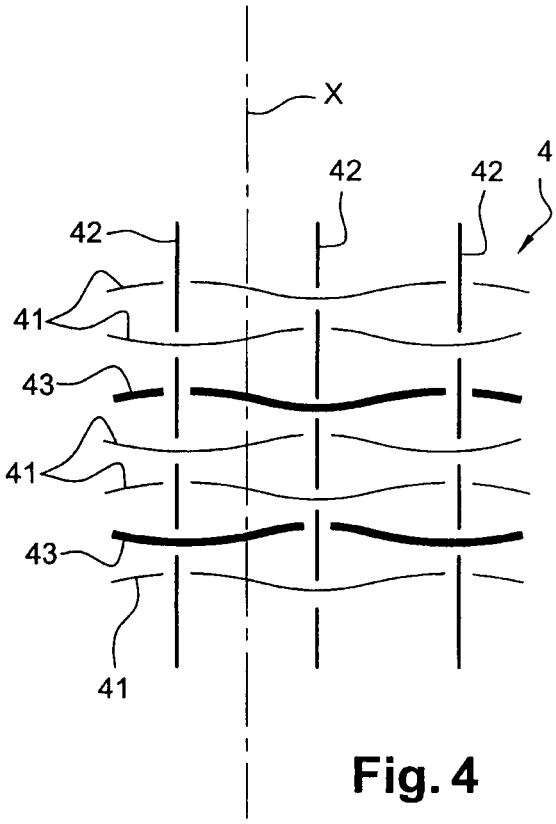
FIG. 4 is an enlarged schematic view of a flexible structure that can be used in an inflatable sleeve according to the invention.

As is shown in FIG. 4, the flexible structure 4 can advantageously include peripheral elastic yarns 43, each one of these elastic yarns 43 extending around the longitudinal axis X, extending at the same time as the peripheral fibers 41, and having as such for effect, when the peripheral fibers 41 are unpleated, to recall these fibers 41 towards their pleated configuration.

In order to optimize their resistance in the structure 4, the elastic yarns 43 are more preferably interlaced with the longitudinal fibers 42, as are also the peripheral fibers 41.

Moreover, rather than giving to the retaining sheath 3 a form of a sock, it may be practical that this sheath be comprised of a belt 5 helically wound around the jacket 2.

In particular, this belt can be comprised of an elastic belt with textile matrix of which the structure 4 is that as shown in FIG. 4.

More precisely, the textile matrix of this belt 5 thus comprises warp yarns 41 which comprise the peripheral fibers, weft yarns 42 which are interlaced with the warp yarns 41 and which comprise the longitudinal fibers 42, and elastic yarns 43 which are parallel to warp yarns 41.

It is possible to superimpose several restraining sheaths, or several levels of belt. In the case of several levels of belt, the coils of the different levels can be wound in the opposite direction (coils to the right on coils to the left).

It is also possible to cover the restraining sheath with an external sheath, for example in rubber and/or by a split tube.

However, it is important that the fibers of the restraining sheath 3 have at least locally a complete freedom of movement in relation to the inflatable jacket 2 and in relation to any possible external sheath.

In particular, the restraining sheath 3 must not be embedded in the inflatable jacket 2 or in the external sheath, or glued to this jacket or to this external sheath, otherwise the dilatation of the inflatable sleeve according to the pressure would no longer be controlled.

The fastening, at the two ends of the packer, of the retaining sheath which may be covered by an external sheath and/or a split tube, can be carried out using rings that crimp these different jackets around two preexisting rings 10 of the sleeve.

Figure 5:
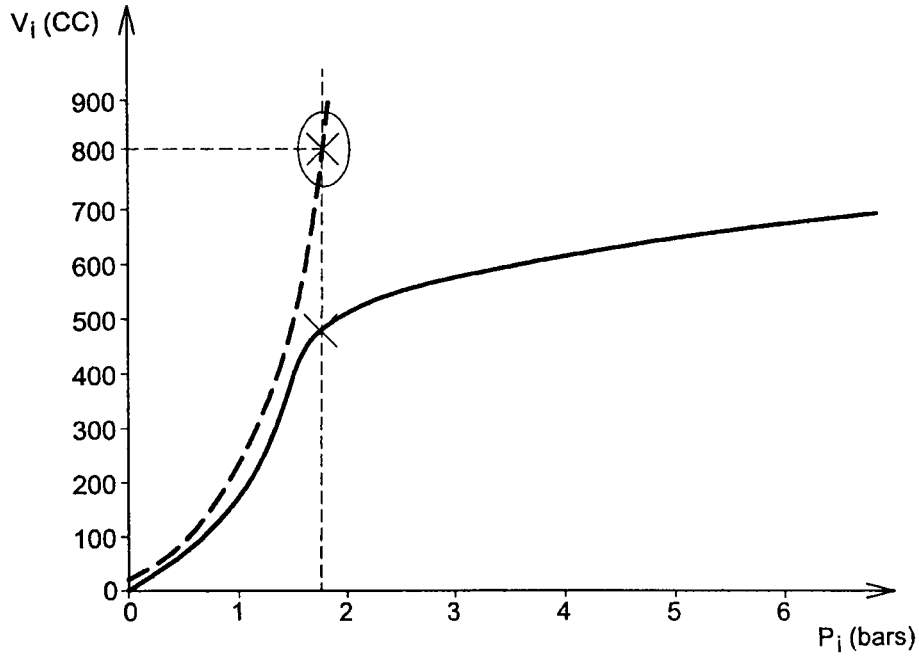
FIG. 5 is a diagram showing, respectively as a dotted line and as a solid line, the change in the internal volume Vi, expressed in cubic centimeters and as a y-coordinate, of a known inflatable sleeve and of a sleeve according to the invention, according to the internal pressure Pi of these sleeves, expressed in bars and as an x-coordinate.

As shown in FIG. 5, the volume/pressure curve of a sleeve according to the invention (as a solid line) is clearly distinguished from the volume/pressure curve of a conventional sleeve (as a dotted line).

In a conventional sleeve, the higher the internal pressure rises, and the more the increase in internal volume becomes high for the same increase in pressure, until the jacket 2 bursts (at about 1.75 bars in the example in FIG. 5, which is relative to pressure metering sensor).

In fact, a sleeve according to the invention has practically the same behavior as a conventional sleeve as long as the flexible structure of the retaining sheath has not reached its state of full elongation, i.e. as long as the peripheral fibers 41 are not fully unpleated.

The only small difference in behavior that can be observed at low pressures between a known sleeve and the sleeve of the invention, at least when it is provided with elastic yarns 43, resides in the fact that the same internal volume can only be obtained, for the sleeve of the invention, through the application of a slightly stronger pressure due to the tensioning of these elastic yarns 43 present in the structure 4.

However, as soon as the textile fibers 41 are tensioned (starting at approximately 1.5 bars), the volume/pressure curve for a sleeve according to the invention reverses its concavity, in such a way that the more the internal pressure Pi rises, the more the increase in internal volume Vi becomes low for the same increase in pressure.

In addition, the internal pressure Pi can be increased substantially without resulting in the bursting of the jacket 2.

Figure 6:
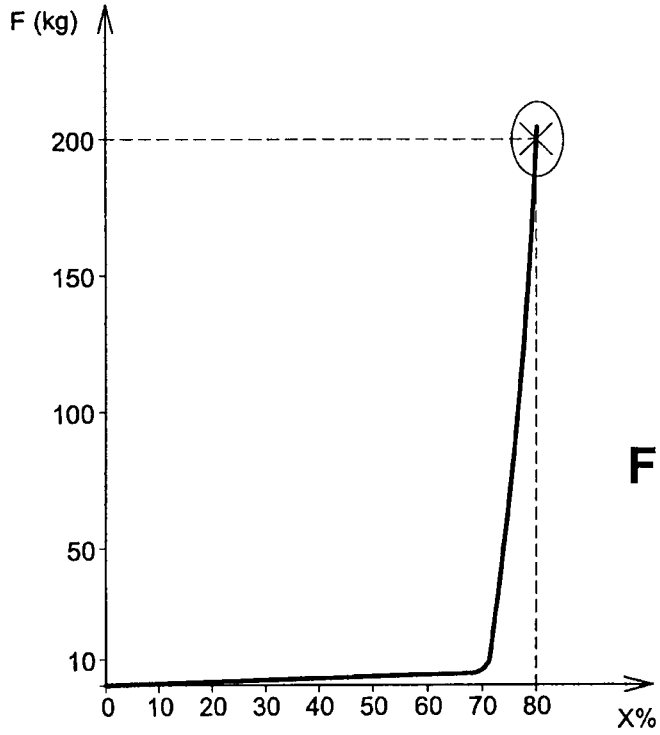
FIG. 6 is a diagram showing the change in the tractive force F, expressed in kilograms and as a y-coordinate, that must be applied to an elastic belt that can be used for the carrying out of a sleeve according to the invention, in order to obtain an elongation X of this belt, expressed in percentage and as a x-coordinate.

The reasons for this behavior can be understood by observing FIG. 6, which shows the tractive force F/elongation X curve of an elastic belt 5 that can be used for the carrying out of a sleeve according to the invention.

As the elastic yarns 43 of the structure 4 of this belt 5 are used only for recalling the fibers 41 towards their pleated configuration and as such do not need to have a high stiffness, an elongation of for example 70 percent can be obtained with a moderate tractive force, of a magnitude of 4.5 kilograms. Nevertheless, it is entirely possible, for particular applications, to increase the stiffness of the sleeve by using more resistant elastic yarns and/or by increasing their number.

However, as soon as the fibers 41 are being stretched, the resistance to the elongation of the belt 5 corresponds substantially to the resistance to the elongation of the fibers 41, in such a way that a moderate elongation can be obtained only through an increasingly higher tractive force, until the rupture of the belt, which takes place only for a tractive force that is as high as these fibers are resistant, this tractive force being, in the example shown in FIG. 6, of a magnitude of 200 kilograms for a belt of 1 centimeter in width.

By providing the conventional sleeve, taken as a reference in FIG. 5, with a restraining sheath carried out with such a belt of a limit resistance of 200 Kg, the bursting pressure of the sleeve equipped as such changes from 1.75 to 40 bars.

As is shown by the comparison of the two halves in FIG. 2, the invention allows for an excellent control of the maximum deformation of an inflatable sleeve, and therefore the elimination of the bulges or of the untimely deformations which frequently occur with the known inflatable sleeves.

Figure 3:
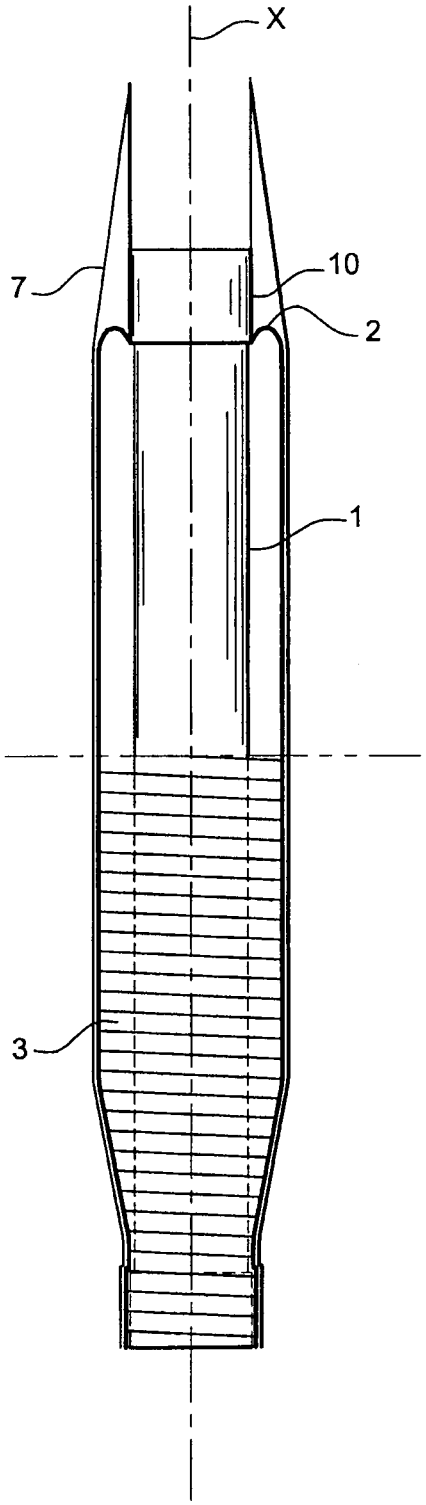
FIG. 3 is a schematic view of two halves of inflatable sleeve encircled by a split tube and shown in configuration of intermediary inflation, the upper half being that of a known sleeve and the lower half being that of a sleeve according to the invention.

As is shown in FIGS. 2 and 3, the invention makes it possible to impose on the sleeve, in the vicinity of each one of its two crimping rings 10, a spindle-shaped profile with, on connection on each ring, a section that remains in its cylindrical initial form and that does not undergo any dilatation regardless of the degree of inflation of the sleeve (effect obtained by positioning, on this portion the restraining sheath in a state of full elongation). The invention as such makes it possible to remove the problems of constraints and excessive deformations that undergo, when they are inflated, the conventional sleeves on their connection with the crimping rings, due to the strong curvature that they take on at this level and which is shown in the upper portion of FIG. 2.

Moreover, the spindle-shaped profile that the invention makes it possible to obtain results in substantially reducing the axial elongation that undergoes the jacket of a conventional sleeve when it is inflated. By way of example, the extended length of the jacket of a conventional sleeve shown in the upper half of FIG. 3, equal to 100 cm at rest, reaches 106 cm when the diameter of the packer, initially at 12 cm, reaches 18 cm, which is an axial elongation of 6 cm. For the same inflating of the packer, with the spindle-shaped profile that the invention makes it possible to impose, shown in the lower half of FIG. 3, the extended length of the jacket is 100.6 cm, which is an elongation 10 times lower than that of the conventional sleeve.

In particular, when the sleeve is enclosed in a split metal tube 7 as shown in FIG. 3, the retaining sheath 3 allows the jacket 2 to faithfully follow the external form of this tube 7, and therefore to avoid the formation of terminal bulges on rings 10, and the appearance of delaminated zones 8.

Figure 7:
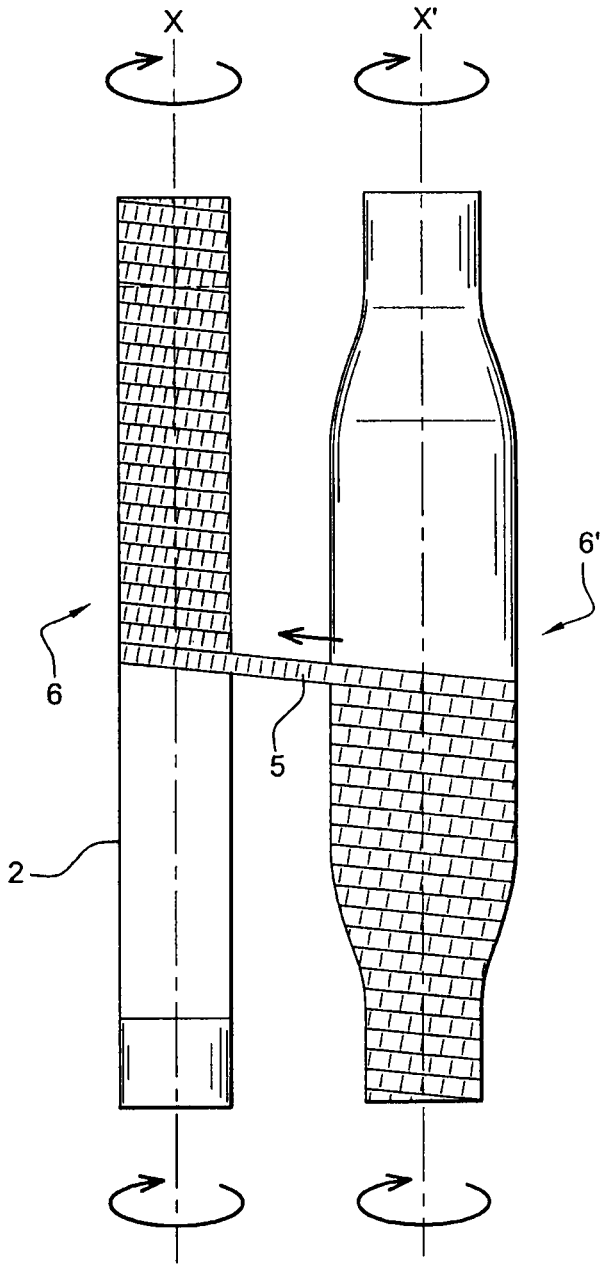
FIG. 7 is a diagram showing a phase of a method able to be implemented for the carrying out of an inflatable sleeve according to the invention.

FIG. 7 shows a final phase of a method able to be implemented, in a non-limiting manner, for carrying out an inflatable sleeve 6 according to the invention, using a sleeve manufactured beforehand in the traditional manner and comprising a mandrel 1 and a sealed inflatable jacket 2.

The operation shown is that which consists in winding a belt 5 around the inflatable jacket 2 of the sleeve 6 in such a way as to control the deformations of this sleeve under pressure.

This final phase entails the prior carrying out of a model 6' on a scale of one of the inflatable sleeve, this model having a longitudinal axis X' and having the form that the inflatable sleeve 6 must adopt in fully inflated configuration.

The model 6' can be made of wood, of plastic material, or of any other sufficiently rigid material in order to not undergo any notable deformation during the operations described hereinafter.

The elastic belt 5 with textile matrix is first helically wound, in its state of full elongation, onto the model 6'.

The relative difference in length that can be observed between the length of the warp yarns 41 of the belt in the state of full elongation and the length of the warp yarns in the pleated state can typically be of a magnitude of several tens to a few hundreds of percent.

The inflatable sleeve 6 is then arranged, in rest configuration, in the vicinity of the model 6'.

As is shown in FIG. 7, it is practical to proceed in such a way that the respective longitudinal axes X and X' of the sleeve 6 and of the model 6' be arranged parallel to each other, at a relatively short distance from one another, for example less than the circumference of the sleeve 6.

One end of the belt 5 wound on the model 6' is then fastened to the end of the sleeve 6 that is across from it.

The model 6' and the sleeve 6 are then simultaneously placed into rotation at the same angular velocity around their respective axes X and X' and in a direction of rotation which makes it possible to unwind the belt 5 from the model 6' and to wind it simultaneously around the sleeve 6.

FIG. 7 shows the case where the direction of the rotation of the model 6' and of the sleeve 6 are the same and where the portion of the belt 5 connecting the model 6' to the sleeve 6 does not cross through the plane passing through the axes X and X', in which case the directions of winding of the belt 5 onto the model 6' and of the sleeve 6 are the same.

It is nevertheless possible to rotate the model 6' and the sleeve 6 in the opposite direction in relation to one another by passing the portion of the belt 5 connecting the model 6' to the sleeve 6 through the plane passing through the axes X and X', in which case the directions of winding of the belt 5 onto the model 6' and of the sleeve 6 are inversed in relation to one another, this solution having the advantage of making it possible to shorten as much as possible the length of the intermediary section formed by the belt that is already unwound from the model 6' and not yet wound onto the sleeve 6.

Regardless of the solution adopted, the state of elongation of the belt 5 on the sleeve 6, for each one of the coils of this belt, is then such that, during future inflation of the jacket 2 of this sleeve, the maximum diameter that this jacket can reach on this coil will be equal to the diameter of the model 6' at this same point, inasmuch as the geometry of the jacket 2 of the sleeve 6 at its maximum inflation will be identical to that of the model 6'.

Alternatively to this method, it is possible to manufacture, by knitting or weaving, a restraining sheath 3 intended to cover the jacket 2 and having the same properties as the bandage accomplished by winding the belt 5.

For this, it is sufficient to use, as an elastic element with textile backing, a yarn element in place of the matrix element with textile backing which comprises the elastic belt 5.

Such an elastic yarn element with textile backing is for example formed by an elastic sheath provided with a textile core with one or several resistant fibers and substantially inextensible, the whole being able to be worked as a yarn able to adopt a rest configuration wherein the fibrous textile core is in pleated configuration, and a full elongation configuration wherein the fibrous textile core is stretched and imposes on the elastic yarn element its own inextensible behavior.

This elastic yarn element is helically wound onto the model 6' in its state of full elongation, as is belt 5, but with the same pitch as that which will be used in the finished retaining sheath 3, such as should result from the knitting or the weaving.

Then, this elastic yarn element with textile backing is unwound from the model 6' by rotation of the latter at constant angular velocity around its longitudinal axis X', while it is used, at constant forward movement speed and simultaneously to its unwinding from the model 6', to manufacture the restraining sheath 3 by knitting or weaving.

The invention claimed is:

1. An inflatable sleeve comprising a mandrel extending along a longitudinal axis and a sealed inflatable jacket connected to the mandrel and selectively adopting a rest configuration or a maximum inflation configuration, said inflatable sleeve further comprising a restraining sheath covering the inflatable jacket, and imposing to the jacket in its maximum inflation configuration a predetermined model form, and said restraining sheath including a flexible structure comprising a belt at least partially formed of substantially inextensible peripheral fibers in a stretched configuration, and said belt being able to adopt a rest configuration in which said peripheral fibers adopt a pleated configuration and a full elongation configuration in which the resistant fibers are fully stretched and impose to the belt their own inextensible behavior, and wherein the relative length difference of the belt between the stretched configuration and the pleated configuration is of a magnitude of at least few hundreds of percent and wherein, said belt being helically wound around the sealed inflatable jacket, forming coils, with each peripheral fiber extending around the longitudinal axis by forming with the longitudinal axis an angle of at least equal to 70 degrees, and wherein, at rest configuration, the belt is set in a partial state of elongation specific for each one of the coils, this partial state of elongation, for a given coil, being such that the relative length difference of the belt between this specific partial state of elongation and its full elongation configuration is equal to the relative increase set for the diameter of the jacket, on this coil, between its rest configuration and its maximum inflation configuration in conformity with the predetermined model form.

2. The inflatable sleeve according to claim 1, wherein the inflatable sleeve presents a spindle shape profile in the vicinity of a connection to the mandrel.

3. The inflatable sleeve according to claim 1, wherein the relative length difference of the peripheral fibers between the stretched configuration and the pleated configuration is of a magnitude of at least 200%.

4. The inflatable sleeve according to claim 1, wherein said elastic belt comprises an elastic sheath.

5. The inflatable sleeve of claim 1, wherein said angle is at least equal to 80 degrees.

6. The inflatable sleeve according to claim 1, wherein the flexible structure further comprises longitudinal fibers intersecting with the peripheral fibers and extending in a direction at least substantially parallel to the longitudinal axis.

7. The inflatable sleeve according to claim 1, wherein said substantially inextensible peripheral fibers are textile fibers.

8. The inflatable sleeve according to claim 1, wherein the flexible structure further comprises peripheral elastic yarns each one of which extends around the longitudinal axis and solicits the peripheral fibers in stretched configuration towards the pleated configuration.

9. The inflatable sleeve according to claim 8, wherein the elastic yarns are interlaced with longitudinal fibers.

10. The inflatable sleeve according to claim 1, wherein the textile matrix of the belt comprises warp yarns forming said peripheral fibers, weft yarns interlaced with the warp yarns and forming the longitudinal fibers, and elastic yarns at least substantially parallel to said warp yarns.

11. A pressure meter probe including an inflatable sleeve as claimed in claim 1.

12. The inflatable sleeve according to claim 1, further comprising a model on the scale of the inflatable sleeve having a form desired for the inflatable sleeve in the fully inflated configuration; said model having a longitudinal axis; an elastic matrix element with textile backing wound on said model; said elastic matrix element with said textile backing being unwindable by driving the model in rotation at constant angular velocity around the longitudinal axis of the model, wherein said elastic matrix element is one of a yarn used to form the retaining sheath and a matrix so that said elastic element is wound directly onto the inflatable sleeve arranged in rest configuration in the vicinity of the model and is driven in rotation around its longitudinal axis at a same angular velocity as the model.

13. The inflatable sleeve according to claim 12, wherein the elastic element with said textile backing is an elastic belt with textile matrix wound directly onto the inflatable sleeve, wherein the longitudinal axes of the sleeve and the model are arranged parallel to each other at a distance at most equal to a circumference of the sleeve, and the sleeve and the model being driven in rotation in the opposite direction or in the same direction according to whether or not the portion of the belt connecting the model to the sleeve crosses a plane passing through said longitudinal axes.

* * * * *